US009096372B2

(12) United States Patent
Vulpitta

(10) Patent No.: US 9,096,372 B2
(45) Date of Patent: Aug. 4, 2015

(54) CONTAINER FOR ADHESIVE TAPE

(75) Inventor: Brian A. Vulpitta, Avon Lake, OH (US)

(73) Assignee: Shurtech Brands, LLC, Avon Lake, OH (US)

( * ) Notice: Subject to any disclaimer, the term of this patent is extended or adjusted under 35 U.S.C. 154(b) by 568 days.

(21) Appl. No.: 13/227,738

(22) Filed: Sep. 8, 2011

(65) Prior Publication Data

US 2012/0055831 A1 Mar. 8, 2012

Related U.S. Application Data

(60) Provisional application No. 61/380,830, filed on Sep. 8, 2010.

(51) Int. Cl.
*B65D 85/00* (2006.01)
*B65D 85/672* (2006.01)
*B65H 75/16* (2006.01)

(52) U.S. Cl.
CPC ..... *B65D 85/672* (2013.01); *B65H 75/16* (2013.01); *B65H 2701/377* (2013.01)

(58) Field of Classification Search
CPC ..... B65D 85/02; B65D 85/04; B65D 85/58
USPC ..... 206/411, 389, 391, 53, 403, 405, 416, 206/417, 748, 504; 277/376
See application file for complete search history.

(56) References Cited

U.S. PATENT DOCUMENTS

| | | | | |
|---|---|---|---|---|
| D118,629 | S | 1/1940 | Reinecke | |
| 2,326,414 | A | 8/1943 | Thompson | |
| 2,476,593 | A | 7/1949 | Gerbing | |
| 2,484,673 | A | 10/1949 | Becker | |
| 2,494,106 | A | 10/1950 | Rengo | |
| 2,547,253 | A | 4/1951 | Bowers | |
| 2,608,295 | A | 8/1952 | Krueger | |
| 2,687,231 | A | 8/1954 | Somers | |
| D179,091 | S | 10/1956 | Pangburn | |
| 2,790,609 | A * | 4/1957 | Hawthorne et al. | 225/26 |
| D187,765 | S | 4/1960 | Gershen | |
| 3,021,987 | A | 2/1962 | Scholtz | |
| D197,935 | S | 4/1964 | Sherman | |
| 3,278,017 | A | 10/1966 | Kearns | |
| 3,525,462 | A | 8/1970 | Freedman | |
| 3,746,225 | A | 7/1973 | Runckel | |
| 4,262,835 | A | 4/1981 | Wrobel | |
| D263,059 | S | 2/1982 | Croyle | |
| D276,822 | S | 12/1984 | Borst | |

(Continued)

FOREIGN PATENT DOCUMENTS

| | | |
|---|---|---|
| EP | 431174 | 7/1935 |
| EP | 746924 | 3/1956 |

(Continued)

*Primary Examiner* — Luan K Bui
*Assistant Examiner* — Rafael Ortiz
(74) *Attorney, Agent, or Firm* — Faye Sharpe LLP; Karl W. Hauber

(57) ABSTRACT

An improved container and container system for adhesive tape reduces the part count necessary for protecting various widths of adhesive tape and provides adhesive tape container elements of low cost. The adhesive tape containers are comprised of two halves with circular side walls and outer walls intended to surround a portion, or all, of the roll of tape (i.e. regular or irregular tape patterns and tape widths), and inner wall segments intended to engage the inside of a core of a roll of tape holding the ensemble together.

12 Claims, 17 Drawing Sheets

(56) References Cited

U.S. PATENT DOCUMENTS

| | | | | |
|---|---|---|---|---|
| 4,570,869 | A * | 2/1986 | Tsuji | 242/578.2 |
| 5,123,582 | A | 6/1992 | Lo | |
| 5,404,651 | A * | 4/1995 | Brodrick | 33/646 |
| D365,852 | S | 1/1996 | Parsey | |
| 5,494,204 | A | 2/1996 | Wang | |
| 5,697,498 | A | 12/1997 | Weisburn | |
| 5,993,711 | A * | 11/1999 | Grunstra | 264/103 |
| D432,575 | S * | 10/2000 | Van Den Berg | D19/69 |
| 6,145,722 | A * | 11/2000 | Behrens et al. | 225/42 |
| 6,386,416 | B1 * | 5/2002 | Dunshee et al. | 225/49 |
| 6,672,532 | B1 * | 1/2004 | Huang | 242/588.6 |
| D486,520 | S | 2/2004 | Sherman | |
| 6,715,710 | B1 | 4/2004 | Russell | |
| 7,051,571 | B2 | 5/2006 | Katoh et al. | |
| 7,178,668 | B2 | 2/2007 | Vovan | |
| D588,934 | S | 3/2009 | Bailey | |
| D598,733 | S | 8/2009 | Taatjes | |
| D618,906 | S | 7/2010 | Covington | |
| 2001/0010258 | A1 * | 8/2001 | Gruber | 156/577 |
| 2003/0078555 | A1 * | 4/2003 | Kerins et al. | 604/385.03 |
| 2006/0123650 | A1 | 6/2006 | Mullins | |
| 2006/0196989 | A1 | 9/2006 | Bartley | |
| 2007/0023314 | A1 * | 2/2007 | Hsu | 206/504 |

FOREIGN PATENT DOCUMENTS

| | | |
|---|---|---|
| FR | 2815950 | 3/2002 |
| GB | 2137164 | 10/1984 |
| JP | 2002-211843 | 7/2002 |

* cited by examiner

CONTAINER FOR ADHESIVE TAPE

This application claims the priority benefit of U.S. provisional application Ser. No. 61/380,830, filed Sep. 8, 2010, the disclosure of which is incorporated herein by reference.

The present disclosure relates to containers for adhesive tape and more particularly to a container which will stay with the roll of adhesive tape beyond the point of sale and be used to protect the roll of adhesive tape after it is purchased by the consumer and partially used. The container is configured to protect the entire roll of adhesive tape and its edges; uniform, patterned, or otherwise, until the tape is completely used.

BACKGROUND OF THE DISCLOSURE

Adhesive tape frequently comprises a long narrow backing of uniform width with pressure sensitive adhesive coated on one side. The backing is sometimes plastic. The backing is sometimes paper. Various adhesives are coated onto the backing. The adhesive coated backing is frequently rolled upon a cylindrical tape core. The tape core is frequently the same width as the tape it carries and is often cardboard or plastic. The tape core often has a relatively smooth cylindrical inner surface appropriate for mounting on a dispenser or for easy manipulation as is.

Adhesive tape products address many needs and are used in various environments. For instance, adhesive tape is used in the home or office in wrapping packages. Adhesive tape of a different construction is used in medical offices, blood donation centers and hospitals to fix absorbent materials, blood donation ports, medical intravenous appliances and the like to the human body. Adhesive tapes are also used in painting and otherwise modifying surfaces of automobiles, homes, offices, and other items. Some painting uses include protecting and/or creating unique designs and patterns on walls, ceilings, floors, et. al.

Some of the tapes used in the above-described environments and applications need protection from the environment for various reasons. Adhesive tapes which are used in some surgical and medical procedures need to be maintained in a sterile state. Adhesive tapes using particular classes of adhesives or additives to the tape need to be separated from the environment either to protect environmental surfaces or to prevent degradation of the adhesive or the additive to the adhesive in the tape. For instance, at least one commercially available masking tape includes materials which gel upon exposure to latex paints. It is important to protect these tapes from exposure to moisture prior to use as moisture may cause gelling of the tape prematurely. This can occur to more than just the outside layer of a roll of tape as the edges of the tape can be contaminated, negatively impacting the performance of the tape. Such tape is often sold in closed plastic containers to protect the edges of the roll of tape from moisture which may be encountered in the form of water or in the form of high humidity in the air. The plastic container is not merely for containing the tape in shipment and in presentation at retail, but also for use by the end user in maintaining the isolation of the tape before application of the tape to the intended work piece. Thus, should an end user use a portion of the roll of tape only on a given day, he may return the roll of tape to the container, close the container and thereby maintain the integrity of the tape and its constituents for use on an another day.

Other tapes used in the above-described environments and applications can include non-uniform widths, and/or irregular or treated edges. Non-uniform widths, along with irregular or treated edges of adhesive tape will need particular protection due to the fragility of the terminal side edges that are not completely supported by (i.e. non-coincidental with) all of the underlying layers nor the underlying tape core when the tape is placed onto a roll.

One conventional container or rolls of tape consists of a tub and lid. The tub has a circular flat bottom and a cylindrical side wall. The lid has a circular top and a cylindrical side wall sized to engage by overlapping the side wall of the tub. Thus, two separate pieces having different dimensions are required to contain a roll of tape. The tape under discussion is offered in various widths. Currently, three widths, 24 mm, 36 mm, and 48 mm are available. This requires a different tub for each size, resulting in four different product pieces for the containers of the tape.

Adhesive tape products are often sold in extremely large quantities in a very competitive environment. The costs of all components of adhesive tape products are therefore important.

The present disclosure contemplates a new package for adhesive tape and a method of packing adhesive tape which is inexpensive to manufacture and versatile in use.

In accordance with an aspect of the disclosure, a method of packaging a roll of adhesive tape is provided having two sides and a core. The method comprises: providing several container halves, each container half having a first side wall having a first circular periphery, a first outer wall extending from the first side wall outer periphery, the first outer wall having a substantially uniform height selected from a set of several heights generally perpendicular to the first side wall, the first outer wall adapted to surround at least a portion of the width of a roll of adhesive tape; at least one first inner wall segment extending from the first side wall inside the first outer periphery, the at least one first inner wall segment adapted to engage at least a portion of the core inner surface; selecting two container halves from the several container halves, the two container halves selected to have first outer wall heights which, together, approximately equal the width of the roll of tape to be packaged; and, applying the selected two container halves to the sides of the roll of tape to be packaged with the inner wall segments engaging the core of the roll of tape.

In accordance with one aspect of the disclosure, a container for a roll of adhesive tape comprises two members, each member having a circular side wall, a cylindrical outer wall extending from the periphery of the side wall and at least one inner wall segment extending from the side wall in the same direction as the outer wall. The heights of the outer walls of the two container members are selected to approximately match the width of the roll of tape to be contained. The inner wall segments are positioned on the side wall to engage the core of the roll of tape. The two members are adapted to engage the two ends of the core of the roll of tape forming a package enclosing the roll of tape and protecting the sides and periphery of the roll of tape.

In accordance with another aspect of the disclosure, a container is provided for a roll of adhesive tape wound upon a core. The roll of adhesive tape having a first side edge and a second side edge and an outer diameter defined by circumferential wraps of tape. The core includes an inner surface and an inner surface diameter. A first member of the container comprises a first side wall having a first circular periphery, a first outer wall extending from the first side wall outer periphery, the first outer wall having a substantially uniform first selected outer wall height generally perpendicular to the first side wall, the first outer wall adapted to surround at least a portion of the width of the roll of adhesive tape. A first inner wall segment extends from the first side wall inside the first outer periphery, wherein the first inner wall segment is conical and adapted to engage at least a portion of the core inner surface. A second member of the container comprises a second side wall having a second circular periphery, wherein a second outer wall extends from the second side wall outer periphery. The second outer wall having a substantially uniform second selected wall height generally perpendicular to the second side wall, wherein the second outer wall adapted to surround at least a portion of the width of the roll of adhesive tape. A second inner wall segment extending from the second side wall inside the second outer periphery, wherein the second inner wall segment is conical and adapted to engage at least a portion of the core inner surface. The first member and the second member adapted to engage the first side and the second side of the roll of tape by engagement of the conical first inner wall segment and the conical second inner wall segment with the core inner surface. The first side edge, the second side edge, and the circumferential wraps of tape are suspended between and separated from the side walls and the outer walls of the respective first member and the second member.

Further in accordance with the disclosure, the inner wall segment can be one continuous cylindrical or conical inner wall or can be several segments of a cylinder or cone spaced from one another. In either case, the inner wall segment is adapted to engage the inner surface of a core of a roll of tape holding the member to the core of the roll of tape.

Yet further in accordance with the disclosure, ribs are provided on the outwardly facing surfaces of the inner wall segments to engage the inner surface of the tape core.

Further still in accordance with the disclosure, the inner wall segment can be a tapered or conical hub or can be several segments of a tapered or conical hub spaced from one another. In either case, the inner wall segment is adapted to engage the inner surface of a core of a roll of tape so that the sides, edges, and outer circumference of the roll of tape are suspended within and/or separated from the container and prevented from touching the sidewalls and outer walls of the container.

Yet further in accordance with the disclosure, the ribs are circumferential, that is, following a circular pattern with the ribs being spaced from the side wall of the container member.

Yet further in accordance with the disclosure, container members are provided with outer walls of several heights so that tapes of several widths can be accommodated in containers economically.

Yet further in accordance with the disclosure, the outwardly facing side wall surfaces of the container members are provided with grooves and ribs which will engage one another when two container members are brought together back to back and aligned.

Still further in accordance with the disclosure, the container member side walls are provided with a foot extending beyond the circular periphery, the foot terminating in a flat edge allowing a contained roll of tape to be stood on the feet.

Yet further in accordance with the disclosure, a method of packaging adhesive tape is disclosed using container halves with a side wall, an outer wall and an inner wall segment. Container halves having various outer wall heights are provided so that two container halves accommodating a selected width of tape may be selected to package the roll of tape.

It is a principal object of the disclosure to provide a container for a roll of tape which will protect the roll of tape from ambient conditions and surroundings which is versatile in application, inexpensive to manufacture, and easy to use.

It is another object of the present disclosure to provide adhesive tape containers which may be fabricated by injection molding using molds without slides.

It is a still further object of the present disclosure to provide adhesive tape containers which can be interlocked with one another whereby multiple rolls of adhesive tape may be sold together and/or stored together conveniently.

It is still another object of the present disclosure to provide an adhesive tape dispenser which can be stably stood on edge for compact storage and also merchandising with the side wall of the container displayed in an easily read vertical position.

It is still another object of the present disclosure to provide an adhesive tape container which is easily understood, disassembled and assembled by the consumer and intuitive in its operation.

It is yet another object of the present disclosure to provide an adhesive tape container consisting of two unitary molded plastic parts which is easily recyclable.

It is yet still another object of the disclosure to provide a container for a regular roll of tape with treated edges and/or an irregular roll of tape, with or without treated edges, which will protect the non-uniform side edges from ambient conditions and from contact with the container itself.

Further objects and advantages of the disclosure will occur from the following detailed description of preferred embodiments thereof and from the accompany drawings in which:

DETAILED DESCRIPTION

Figure 1:
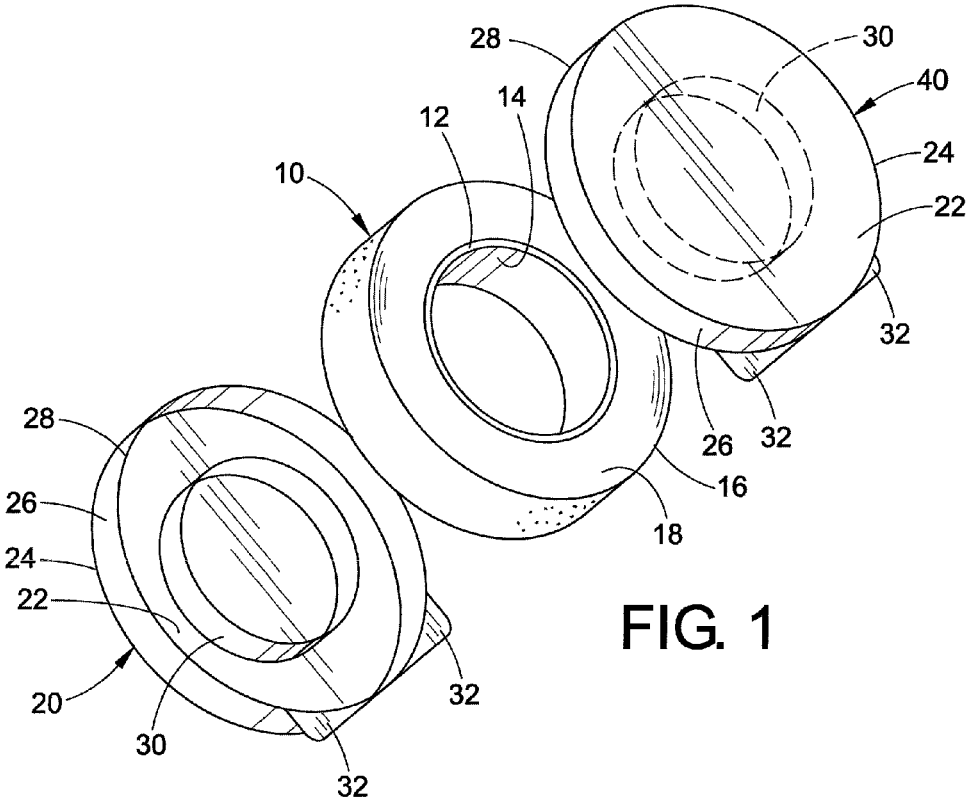
FIG. 1 is a disassembled view of two container elements on either side of a roll of tape in the orientation the container halves are in for application.

Referring now to the drawings which are for the purposes of illustrating preferred embodiments of the disclosure only and not for the purposes of limiting same, the figures show rolls of tape and container elements for containing these rolls of tape.

Referring now to FIG. 1, a roll of tape 10 comprises a core 12 having an inner cylindrical surface 14. A length of adhesive tape 16 is wound on the core 12. The roll of tape 10 is conventional. Such rolls of tape are available commercially having conventional widths such as one-half inch, 24 mm, 36 mm, 48 mm, 2 inches, and others. Rolls of tape come with various lengths of tape on the roll. Rolls of tape come on a number of different size cores. One popular size core is a three inch core in which the inside diameter of the cylindrical core 12 is uniformly approximately 3 inches. Other tape core diameters are also available along with tape core diameters different from the tape width. The size of the tape and width, length of tape upon the core, and core diameter can vary in practicing the present invention. One aspect of the present invention is the provisioning of containers for varied widths of tape and cores at reduced cost and reduced inventory part count.

The sides 18 of the roll of tape comprise the sides of the tape core 12 and the edges of the tape 16 wound upon the core 12. The two sides 18 are identical to one another. The sides 18 of the roll of tape sometimes require protection. If a particular tape is provided to present straight edges as in precision masking, one may wish to prevent the sides 18 from being nicked, gouged or dented by objects. If the tape 16 contains adhesive which is particularly tenacious or otherwise active, it may be appropriate to protect the edges of the roll of tape from contact with unintended substrates. If the tape 16 contains materials which may react to substances that may be encountered in retailing, use of the tape or in the atmosphere, it may be appropriate to protect the edges, and indeed the entire roll of tape, from the environment.

A first container member 20 comprises a circular side wall 22 having a periphery 24, an outer wall 26, an inner wall segment 30 and feet 32. The outer wall 26 is cylindrical and extends from the periphery 24 of the side wall 22 to a circular outer wall remote edge 28. The distance from the periphery 24 of the side wall 22 to the outer wall remote edge 28 is generally uniform giving the outer wall a generally uniform height around its entire circumference. The diameter of the outer wall 28 is selected to be slightly greater than the diameter of the roll of tape 10 to be contained.

The inner wall segment 30 illustrated in FIG. 1 is a continuous, cylindrical, inner wall segment 30. The inner wall segment 30 has a substantially uniform height dimension selected to be not more than half the width of the roll of tape 10 to be contained. The diameter of the inner wall segment 30 is selected so that the inner wall segment 30 will fit snuggly inside the tape core 12 engaging the tape core's cylindrical inner surface 14.

Two feet 32 extend from the outer wall remote edge 28. The feet 32 are adjacent one another having a common flat edge ending in rounded corners leading to second edges which join the outer wall remote edge. This forms two feet 32 with a common straight bottom edge.

A second container member 40 is seen to the right of the roll of tape 10 in FIG. 1. The second container member 40 is identical in all respects to the first container member 20. Its orientation is different. The second container member 40 is orientated such that the inner wall segment 30 of the second container member 40 will engage the right hand side of the tape core 12 while the first container member 20 engages the left hand side of the tape core 12.

Figure 2:
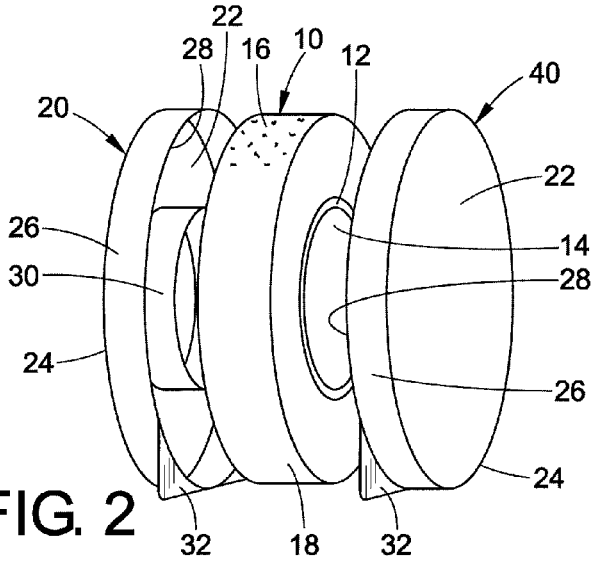
FIG. 2 is a view similar to FIG. 1 with the container halves more closely approaching the roll of tape.
Figure 3:
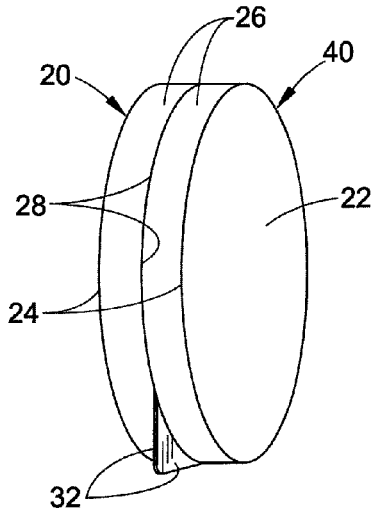
FIG. 3 is a view of the container assembled onto the roll of tape enclosing the roll of tape.

With reference to FIG. 2, the first container member 20, the second container member 40 and the roll of tape 10 are shown properly aligned for engagement. With reference to FIG. 3, the first container member 20 and the second container member 40 have been brought together engaging the roll of tape 10 and completely enclosing and containing the roll of tape 10. The roll of tape 10 is thus protected from injury by impact with sharp objects and by degradation by interaction with environmental constituents.

Figure 4:
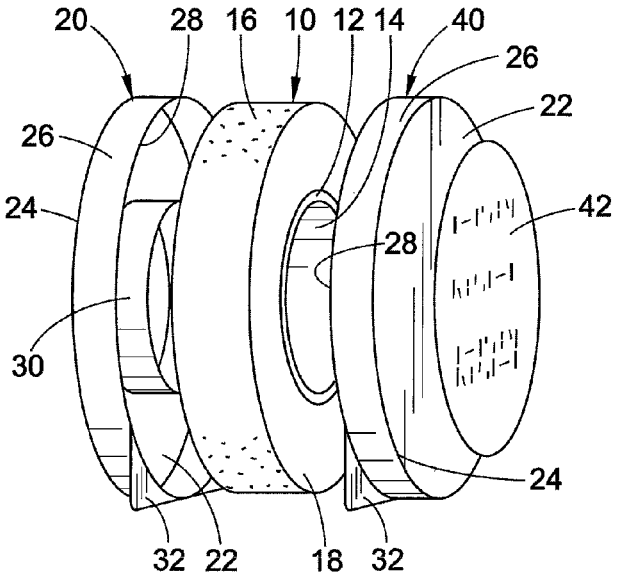
FIG. 4 is a view similar to FIG. 2 showing the application of a retailing label to the container.
Figure 5:
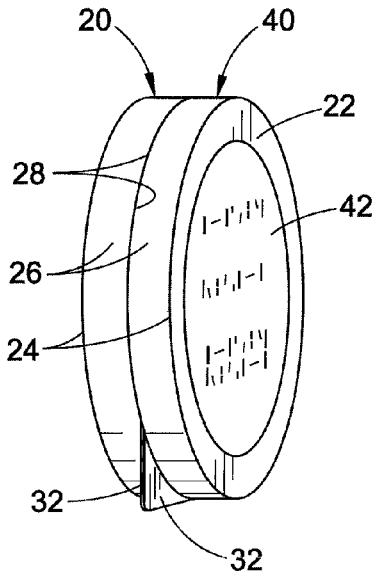
FIG. 5 is a view similar to FIG. 3 illustrating the label as applied to the container closed on the roll of tape.

Referring now to FIG. 4, a retail label 42 bearing information for retailing products such as adhesive tape is show just prior to application to one of the container members 20, 40. The retail label is orientated with its bottom adjacent the feet 32 of the container members 20, 40. As can be seen in FIG. 5, this facilitates presentation of the roll of tape 10 within the container members 20, 40 in an upright position with the label properly orientated for reading by a consumer. This is significantly advantageous when tape products are presented at retail on shelves. An easily identified and read retail container is more convenient for the consumer.

The container halves 20, 40 seen in FIGS. 4 and 5 each have an outer wall height. The distance from the side wall 22 to the outer wall remote edge 28 being about 12 mm. This allows the two container halves 20, 40 to completely enclose a roll of tape of 24 mm width.

Figure 6:
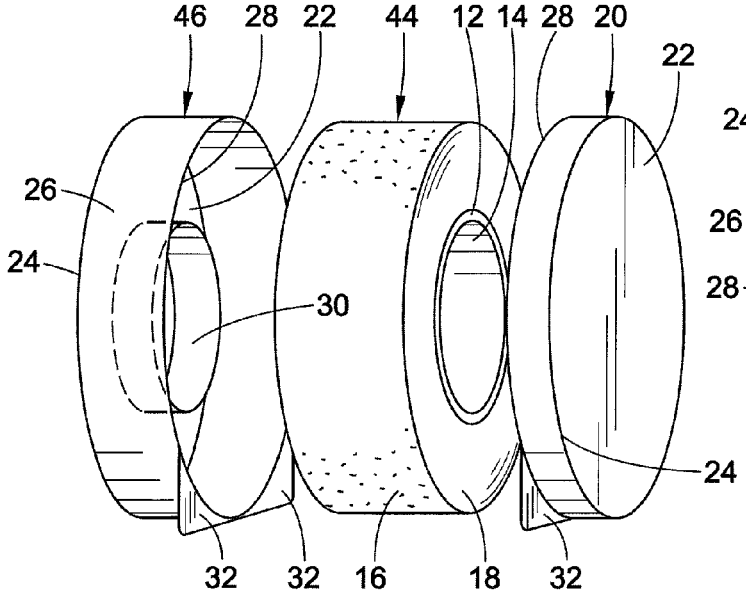
FIG. 6 shows two container halves about to be applied to a roll of tape of a different width than that seen in FIG. 4.
Figure 7:
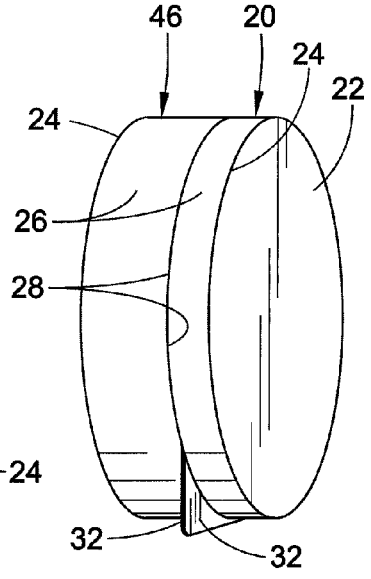
FIG. 7 shows the container of FIG. 6 closed upon the roll of tape.

FIG. 6 illustrates a roll of tape 44 having a width of 36 mm. The roll of tape 44 is contained between two container members, a first container member 20 and a modified or third container member 46. The third container member 46 is identical to the first container member 20 in all respects except the distance from the side wall 22 to the outer wall remote edge 28 which is 24 mm rather than 12 mm. With reference to FIG. 7, when the third container member 46 and the first container member 20 are brought into engagement with the roll of tape 44, they completely enclose the roll of tape 44 as the height of the two outer walls are 24 mm and 12 mm covering the 36 mm width of the roll of tape.

Figure 8:
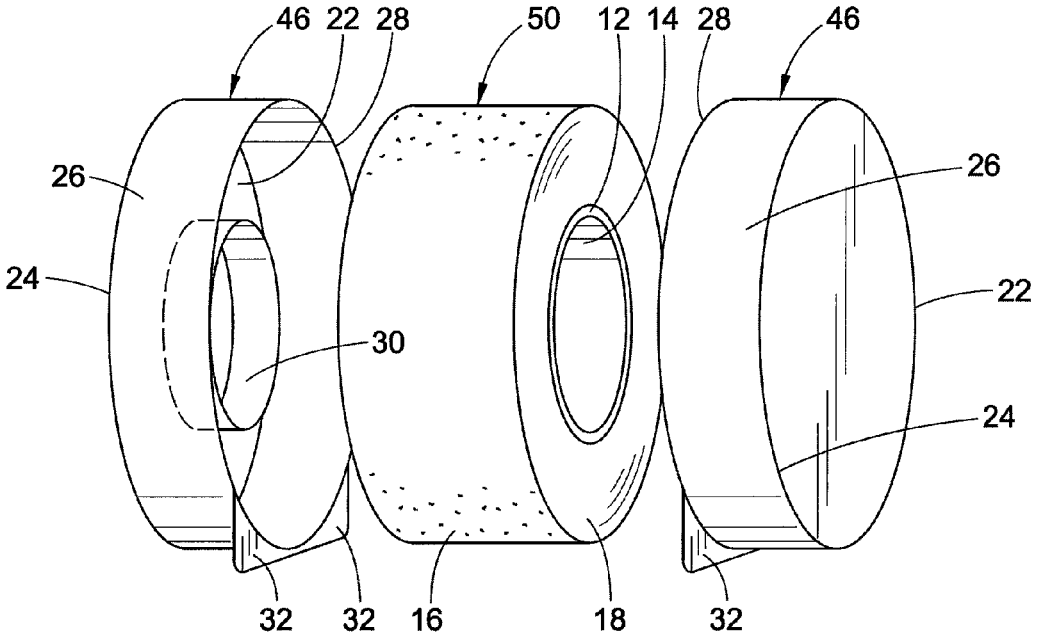
FIG. 8 shows a container in accordance with the disclosure about to be applied to a roll of tape of a third width.
Figure 9:
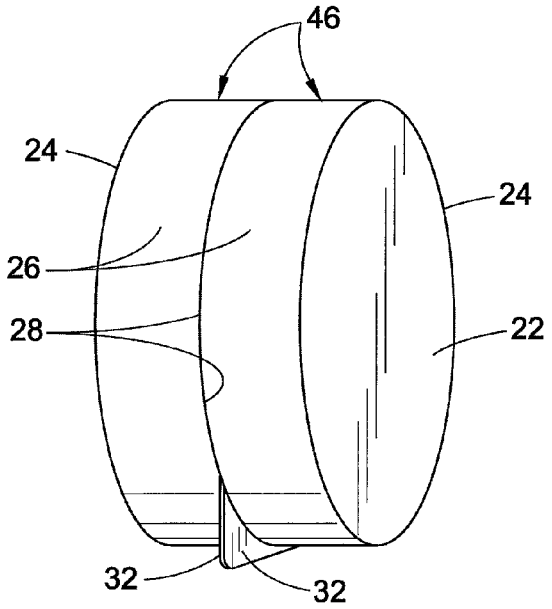
FIG. 9 shows the container of FIG. 8 applied to the roll of tape.

FIG. 8 illustrates a 48 mm width roll of tape 50 flanked by two copies of the third container 46. FIG. 9 shows the 48 mm roll of tape 50 enclosed by the pair of third container members 46. As can be seen in FIG. 9, the height of the outer wall in the third container member 46 is approximately 24 mm and the two outer walls together fully enclose the 48 mm wide roll of tape 50.

Figure 10:
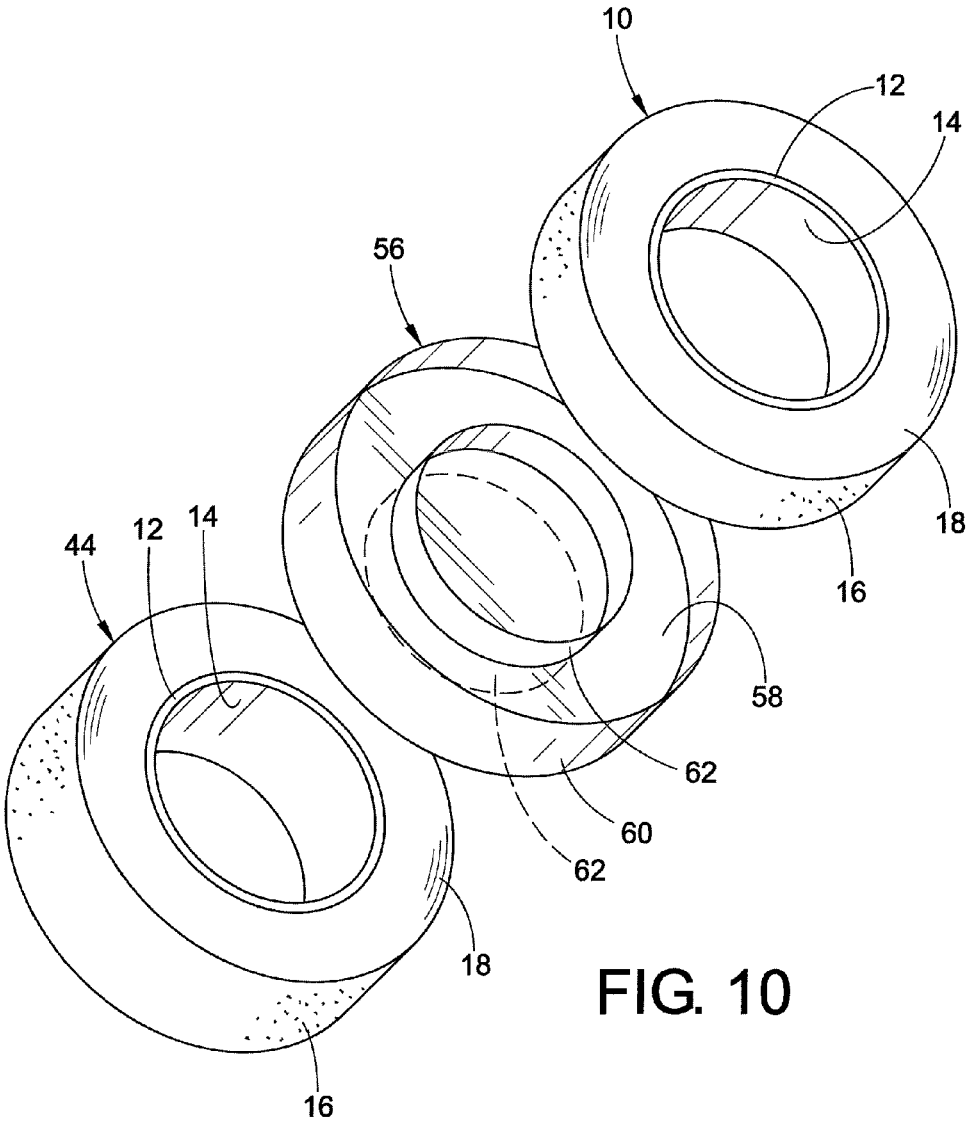
FIG. 10 shows a connector in accordance with the disclosure aligned between two adjacent rolls of tape.

Referring now to FIG. 10, a first connector 56 is shown between a 24 mm roll of tape 10 and a 36 mm roll of tape 44. The first connector 56 has similarities in structure to the container members. Thus, the first connector 56 has a circular side wall 58 with a circular outer periphery. An outer wall 60 extends from the periphery of the side wall 58. However, the outer wall 60 in the connector extends in both directions from the side wall 58. The first connector 56 has two cylindrical inner wall segments 62, one extending from each side of the side wall 58. The side wall 58 can be a complete disk or an annulus with the portion of the side wall 58 inside the inner wall segments 62 omitted. The inner wall segments 62 are identical in height and construction to the inner wall segments in the container members previously described. The outer wall 60 extends a distance on either side of the side wall 58 appropriate to enclose a portion of the selected roll of tape. Connectors 56 can have outer walls 60 of different height.

Figure 11:
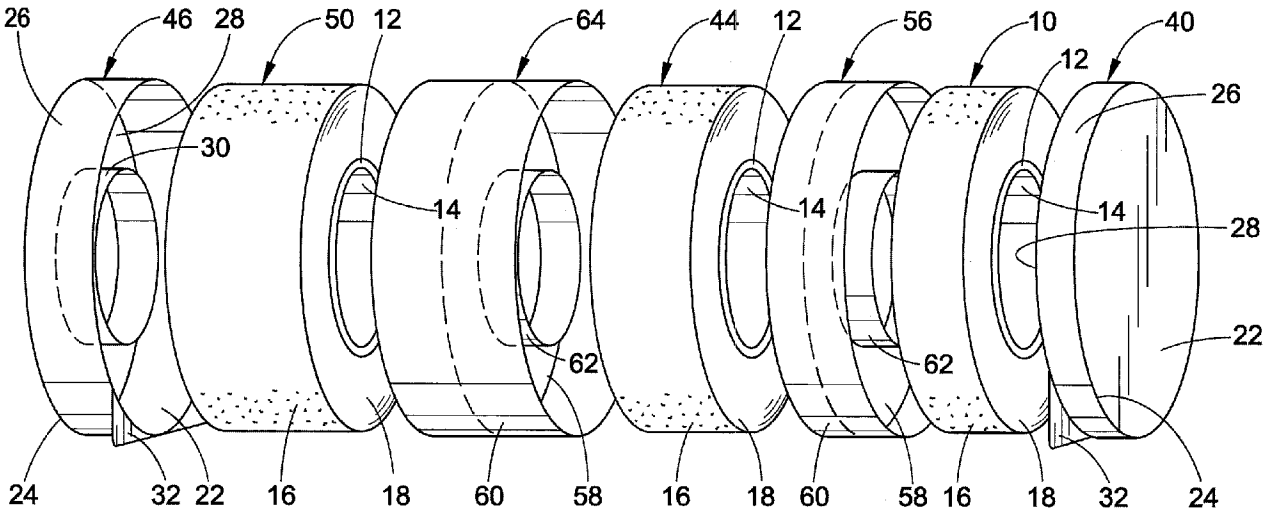
FIG. 11 shows the use of two connectors similar to that seen in FIG. 10 and additional container members about to be applied to three rolls of tape.
Figure 12:
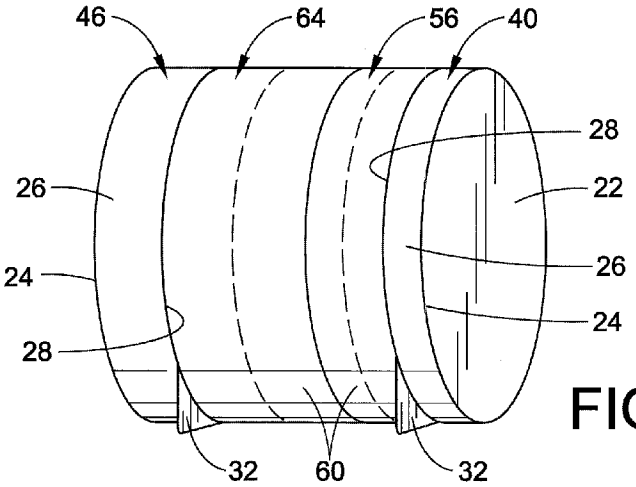
FIG. 12 shows the connector elements, container elements and rolls of tape seen in FIG. 11 in the assembled, closed position.

Referring to FIG. 11, one sees an array of three rolls of tape 10, 44, 50, two container members 40, 46, a first connector 56 and a second connector 64. The first connector 56 has an outer wall 60 which is 24 mm in total height. The second connector 64 has an outer wall which is 48 mm in total height. In all other respects, the two connectors 56, 64 are identical. FIG. 12 shows the rolls of tape, container members and connectors of FIG. 11 fully assembled. The three rolls of tape are completely enclosed with the outer walls of the container members and connectors abutting one another forming a continuous cylinder protecting the tape. Moreover, the three rolls of tape of varying widths are held together in a convenient container which is easily labeled and displayed at retail and also easily stored and used by the consumer. Note the positioning of the feet 32 supporting the assembled package of tape in an orientation where the principle label will be easily seen by the consumer or user.

Figure 13:
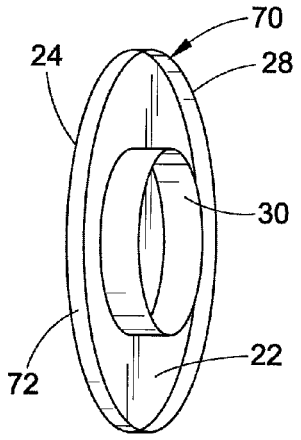
FIG. 13 shows an alternate embodiment for a container member in accordance with the present disclosure.
Figure 14:
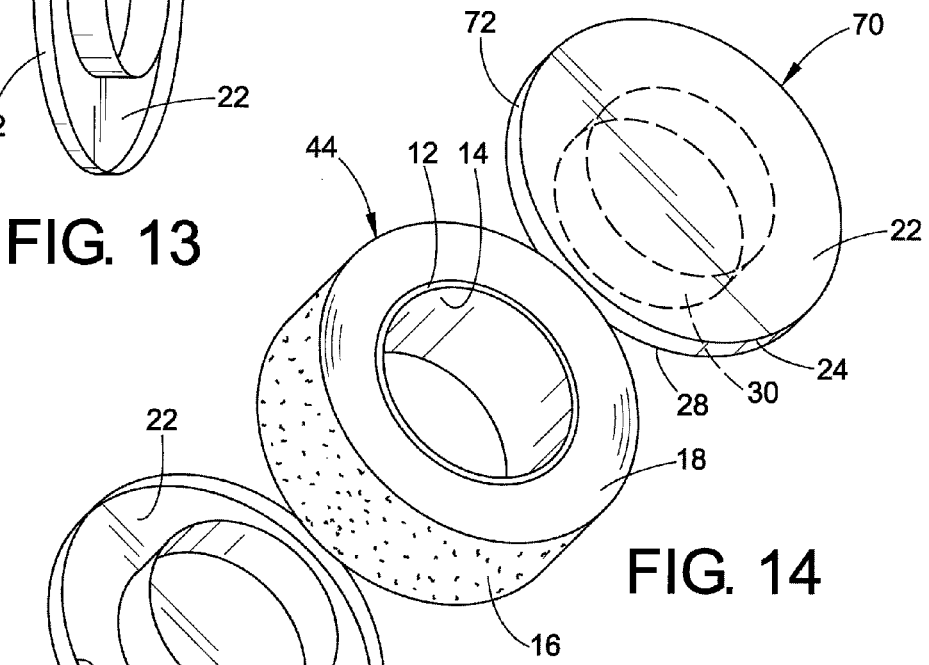
FIG. 14 shows two container members as seen in FIG. 13 about to be applied to a roll of tape.
Figure 15:
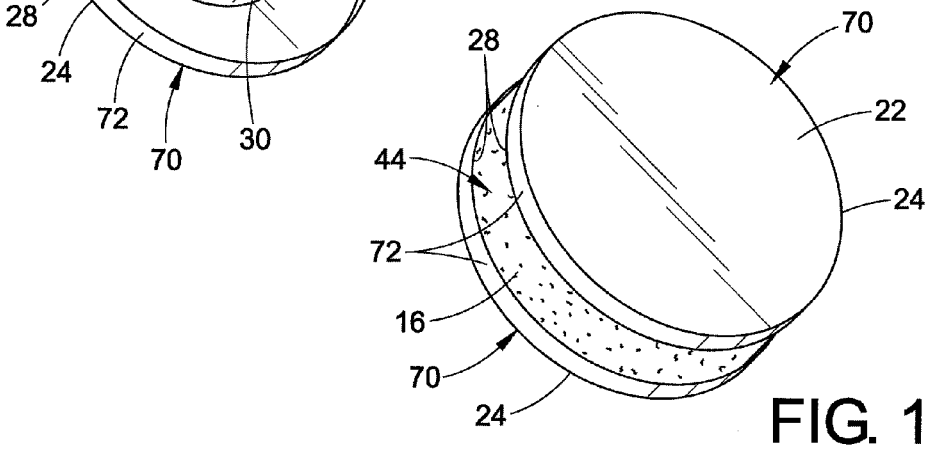
FIG. 15 shows the container members and roll of tape seen in FIG. 14 in the assembled condition.

FIG. 13 shows a tape container system having some differences from the system seen in FIGS. 1-12. A fourth container member 70 is illustrated in FIG. 13. The fourth container member 70 is substantially similar to the first container member 20 seen in FIGS. 1 and 2. It has a side wall 22, a side wall periphery 24 an outer wall 72, an outer wall remote edge 28 and an inner wall segment 30. The fourth container member 70 does not have feet 32. Rather, nothing extends radially beyond the periphery 24. The outer wall 72 is less high than the outer wall 26 of the first container member. FIG. 14 illustrates alignment of two fourth container member 70 with the roll of tape just prior to applying the container members to the roll of tape. FIG. 15 shows the application of two fourth container members 70 to a roll of tape 44. The two container members 70 completely cover the edges of the roll of tape 44 and the edge portions of the outside layer of adhesive tape 16. However, the middle portion of the outside layer of adhesive tape 16 is exposed. Thus, the edges, the most vulnerable parts of a tape, are protected. Any width of tape can be protected in this manner with a single design of the fourth container member 70. In all other respects, the fourth container member 70 operates nearly identical to the first container member 20.

Figure 16:
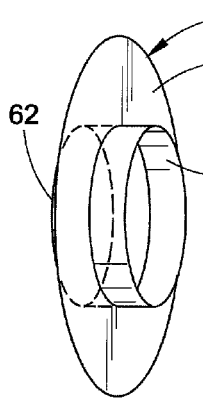
FIG. 16 shows a connector usable with the container shown in FIGS. 14 and 15.
Figure 17:
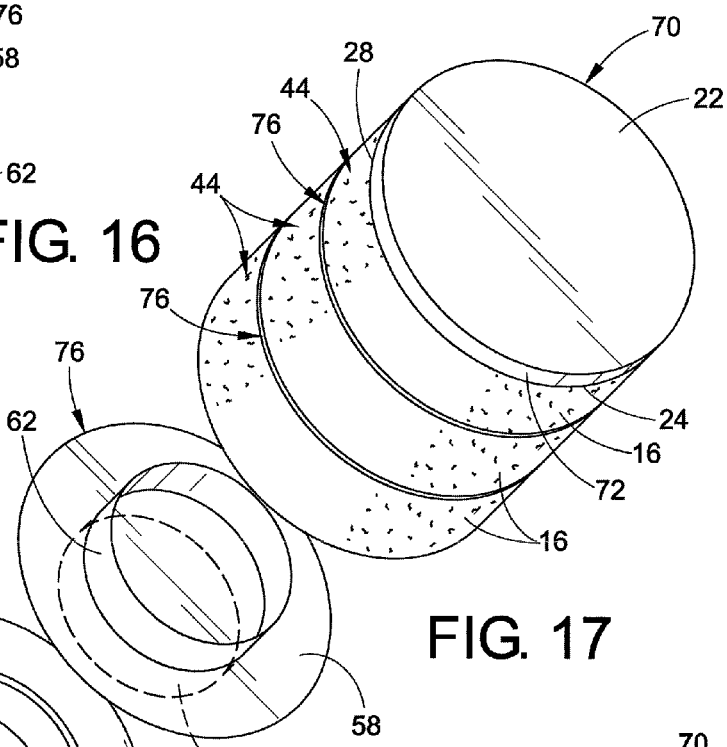
FIG. 17 shows a connector of FIG. 16 about to engage two adjacent rolls of tape.
Figure 18:
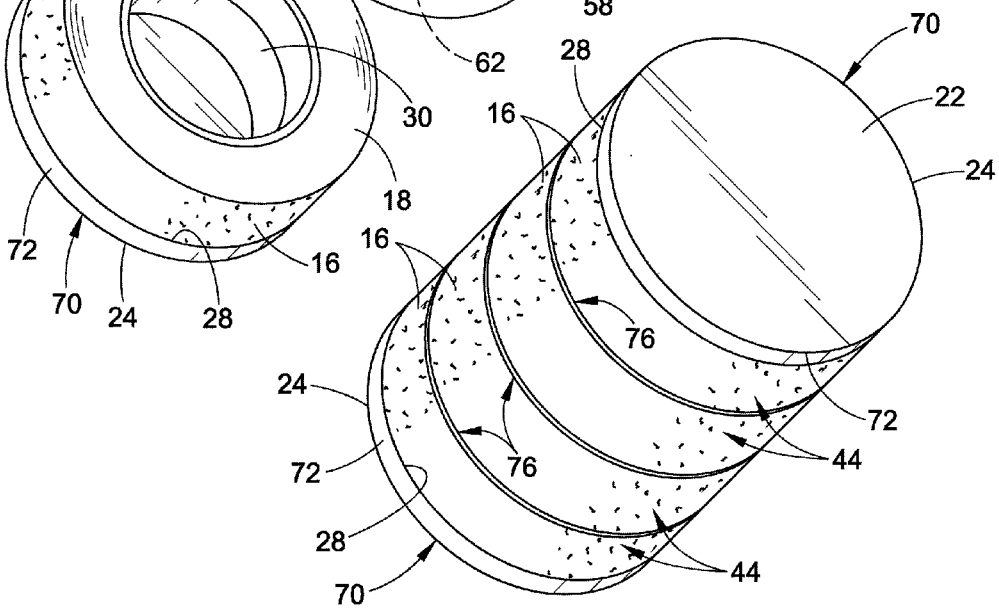
FIG. 18 shows the container members connectors and rolls of tape of FIG. 17 in the assembled condition.

FIG. 16 illustrates a third connector 76. The third connector 76 resembles the first connector 56 in that it has a side wall 58 with inner wall segment 62 projecting from each side of the side wall 58. The third connector 76 does not have an outer wall. FIG. 17 illustrates the use of a third connector 76 with several rolls of tape. Several rolls of tape 44 having cores of identical inner diameter are aligned with connectors 76 placed between each pair of adjacent rolls of tape. The inner wall segments 62 on a third connector 76 engage the cores of the two adjacent rolls of tape. In this way, four rolls of tape may be held together in aligned relationship by three connectors 76. Fourth container members 70 are applied to the outwardly facing edges of the outboard rolls of tape 44. In this way a multiple unit stack of rolls of adhesive tape are created as seen in FIG. 18. The edges of each roll of tape are protected from the environment and also from adjacent rolls of tape by the side walls 58 of the third connectors 76. The outboard edges of the outboard rolls of tape are protected by the fourth container members 70. Moreover, the four rolls of tape are held together for presentation at retail and for storage by the end user.

Figure 19:
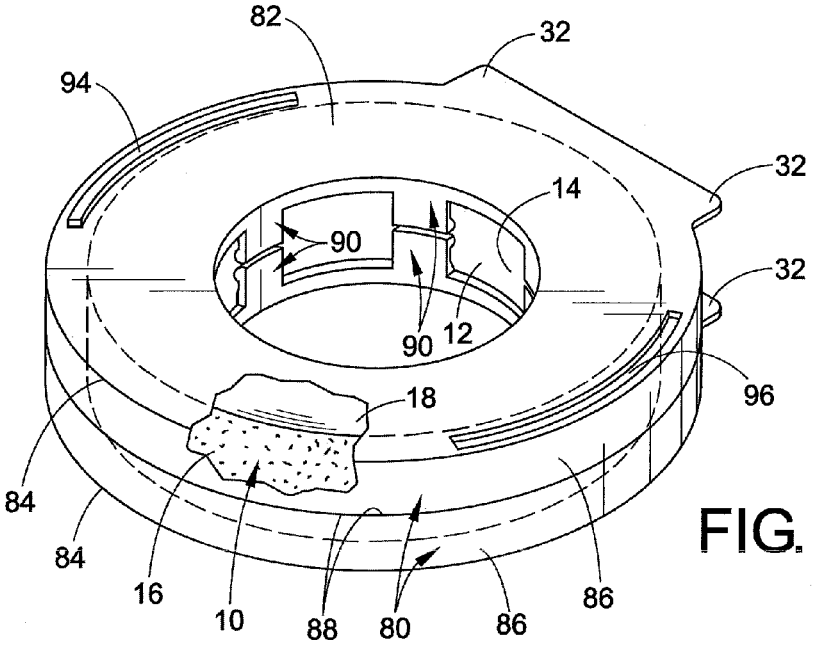
FIG. 19 shows another embodiment of a container for adhesive tape in accordance with the present disclosure.

Another embodiment of the disclosure is seen in FIGS. 19, 20, 29, 30, 31 and 32. With reference to FIG. 19, two fifth container members 80 are applied to a roll of tape 10. The fifth container members each have side walls 82 with a generally circular periphery 84 and a cylindrical outer wall 86 extending from one side of the side wall 82 at the periphery 84. The outer walls 86 have outer wall remote edges 88. In this case, the outer walls have a height equal to one half the width of the roll of tape contained so that the outer wall edges 88 abut one another when the container members 80 are applied to the roll of tape 10. The fifth container member 80 also has inner wall segments 90. The inner wall segments 90 are more complex than the inner wall segments seen in previous embodiments. The fifth container member 80 also has feet 32 with flat edges forming a base upon which the tape container formed of the two container members 80 may be stood. Side wall 82 of the fifth container member 80 is an annulus. That is, it resembles a washer with a hole in the middle.

An arcuate rib 94 is provided on one side of the side wall 82. An arcuate groove 96 having dimensions similar to the arcuate rib 94 is provided in the other side of the side wall 82. The rib 94 and groove 96 are on the same outwardly facing face of the side wall 82 but are diametrically opposed from one another on that face. While not visible in FIG. 19, the bottom fifth container member 80 is identical to the top fifth container member except for orientation. Thus, the rib and groove appear on the outwardly facing face of the bottom container member as well.

Figure 20:
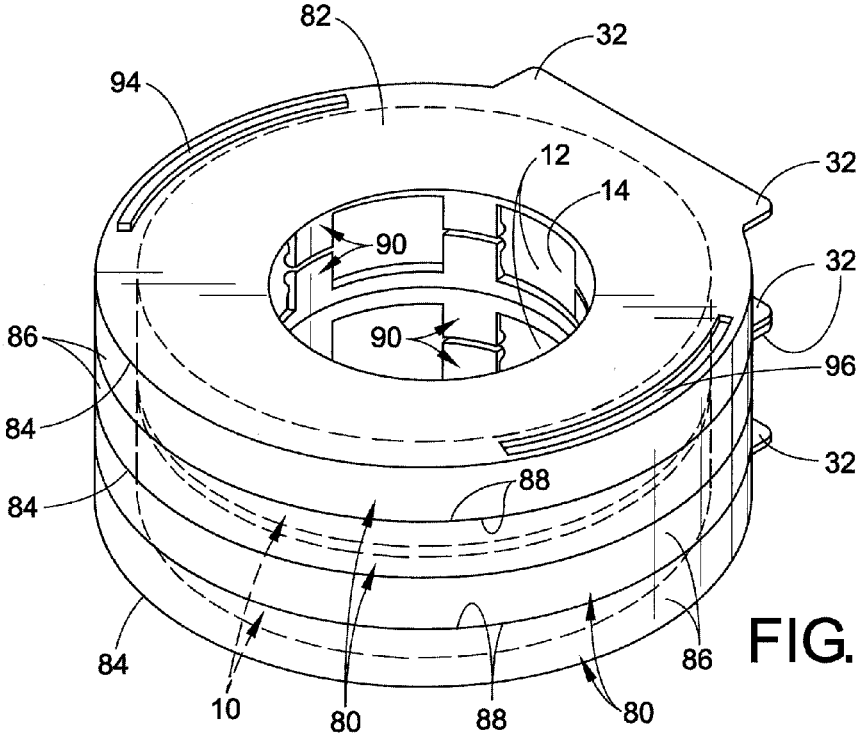
FIG. 20 shows the container of FIG. 19 partially translucent and transparent with a roll of tape.

Referring to FIG. 20, a stack of four fifth container members 80 orientated to contain two rolls of tape 10 and to engage one another is illustrated. The top two container members 80 engage a roll of tape 10 with the inner wall segments 90 engaging the core 12 of the roll of tape holding the container members together forming a complete container. The bottom two container members 80 perform identically with a second roll of tape. The two pairs of containers are aligned with one another and brought into contact with a groove 96 on one container half accepting the rib 94 on the other container half. The adjacent containers are held in alignment and may be laid down on their side or stood on their feet 32 for display for sale or for storage. Because the side walls are open at their center, the rolls of tape in their containers may be displayed on hooks or pegs with labeling around the periphery of the side wall which will be orientated correctly as the weight of feet 32 will draw the bottom of the container and tape downwardly into a proper orientation.

Figure 21:
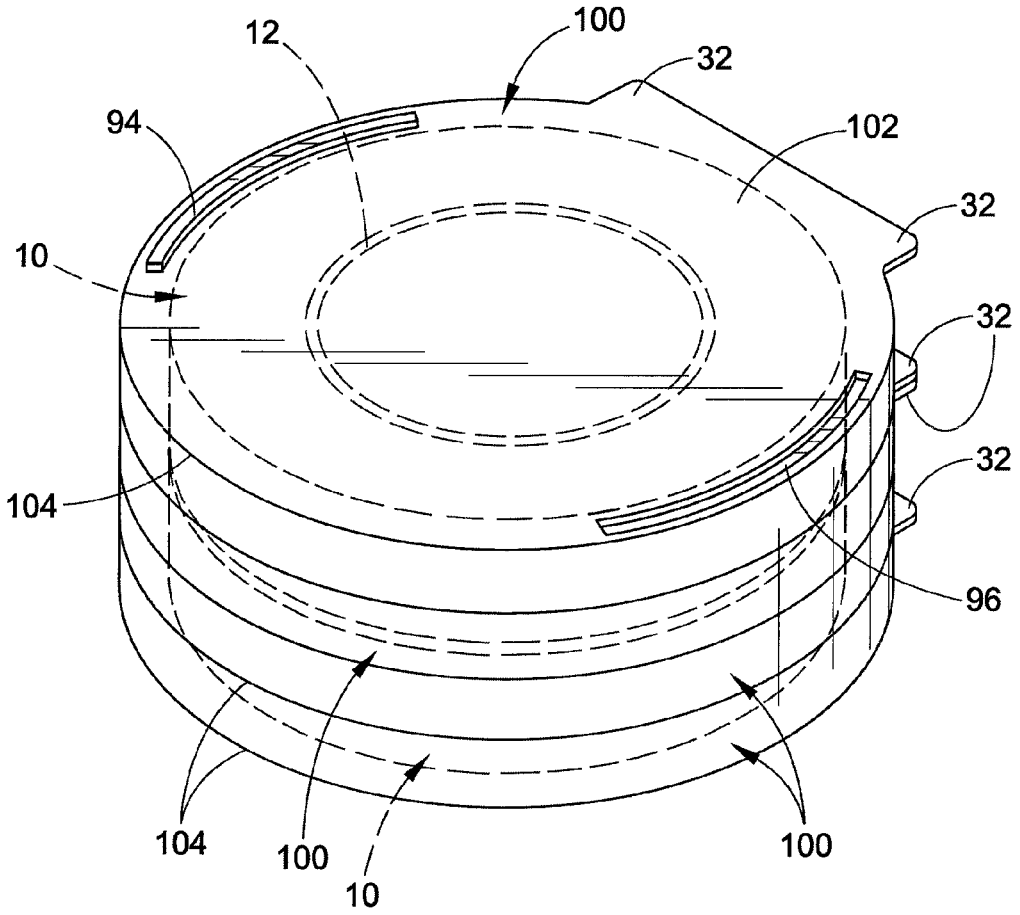
FIG. 21 shows another embodiment of a container or a roll of tape in accordance with the present disclosure.

FIG. 21 shows a stack of sixth container members 100. Each of the four container members are identical in all respects. Each of the four container members 100 show substantial similarities with the previously described container members. The sixth container member 100 has a side wall 102 which is disk like and substantially circular with feet 32 extending from one side of the periphery 104 of the side wall 102. The sixth container member 100 has an arcuate rib 94 on one side and an arcuate groove 96 on the other side. The arcuate rib 94 and the arcuate groove 96 are identical to those seen with respect to the embodiment seen in FIG. 19.

Figure 22:
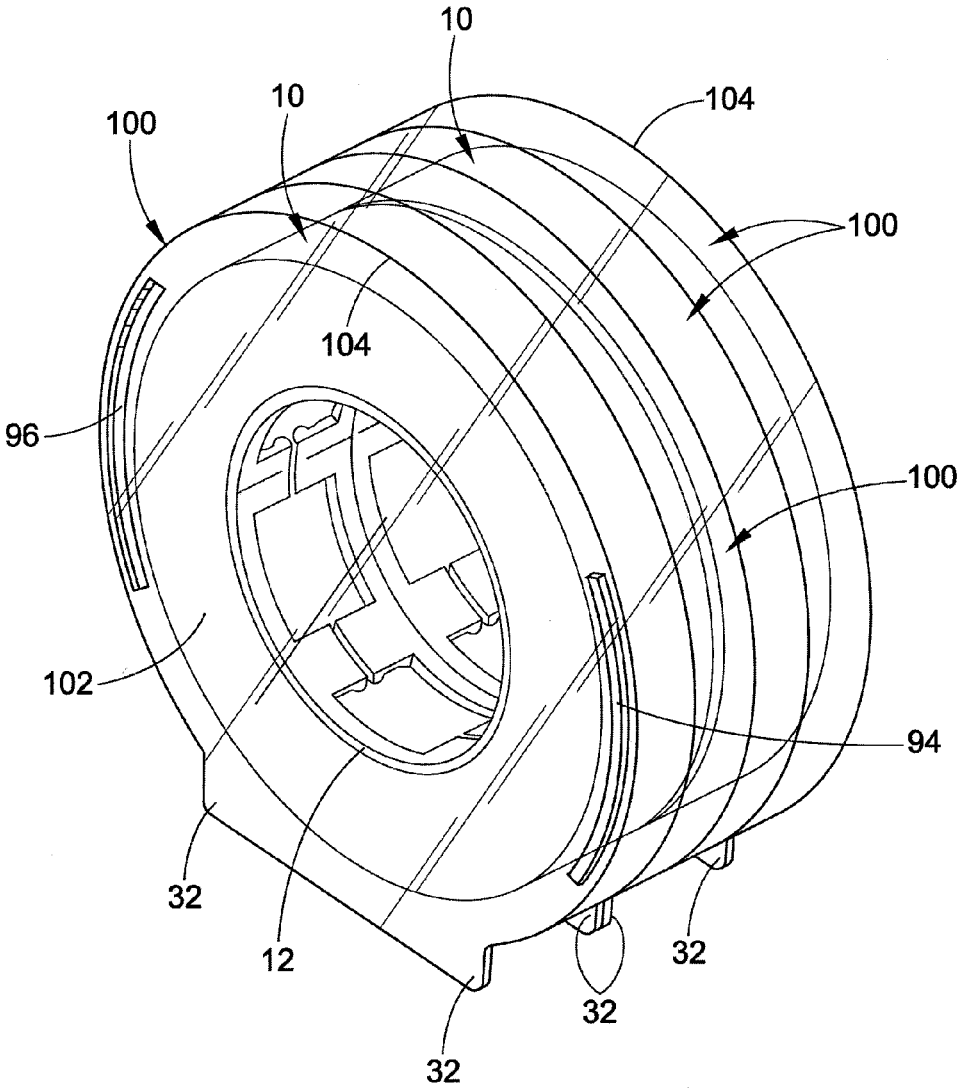
FIG. 22 shows the container of FIG. 21, partially translucent, assembled to two rolls of tape.

FIG. 22 shows the stack of container members 100 seen in FIG. 21 shown as translucent and illustrating the contained rolls of tape 10 within the container members. The container members 100 may be but are not necessarily translucent. They are shown as translucent in this illustration for purposes of clarity. It can be seen that four container members 100 are aligned coaxially with a first pair of container members 100 enclosing a first roll of tape 10 and a second pair of container members enclosing a second roll of tape. The two pairs of container members are held in alignment by the engagement of the rib 94 in the groove 96 in adjacent members. The assembled container members and rolls of tape stand on feet 32 providing a stable, attractive retail package.

Figure 23:
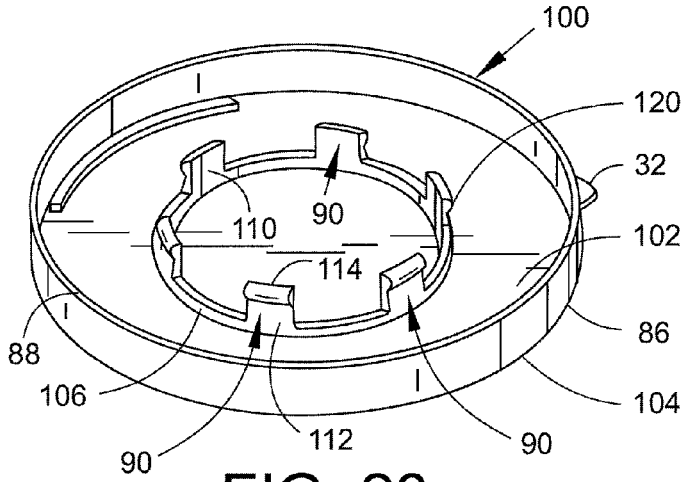
FIG. 23 is a perspective view of one element of the container of FIGS. 21 and 22.

FIG. 23 shows the sixth container member 100 also seen in FIG. 21. The side of the sixth container member 100 which will engage a roll of tape is seen in FIG. 23. The major difference between the sixth container members and the first through fourth container members is illustrated. Thus, rather than a continuous singular cylindrical wall segment 30, several, in this case six, inner walls segments 90 are present. The inner wall segments 90 are all located in a circular array with the circle being coaxial with the outer wall 86 and spaced inwardly from the outer wall 86. Thus, the inner wall segments 90 appear as six evenly spaced portions of a cylinder with voids therebetween. This provides advantages in gripping the cylindrical inner surface 14 of a tape core 12. Because the inner wall segments 90 are not continuous, their ends remote from the side wall 102 may be displaced inwardly at the tape core. Because the container members are fabricated from a polymer material having resilience, displacing the inner wall segments 90 inwardly will create an outwardly directed force which will engage a tape core.

Figure 24:
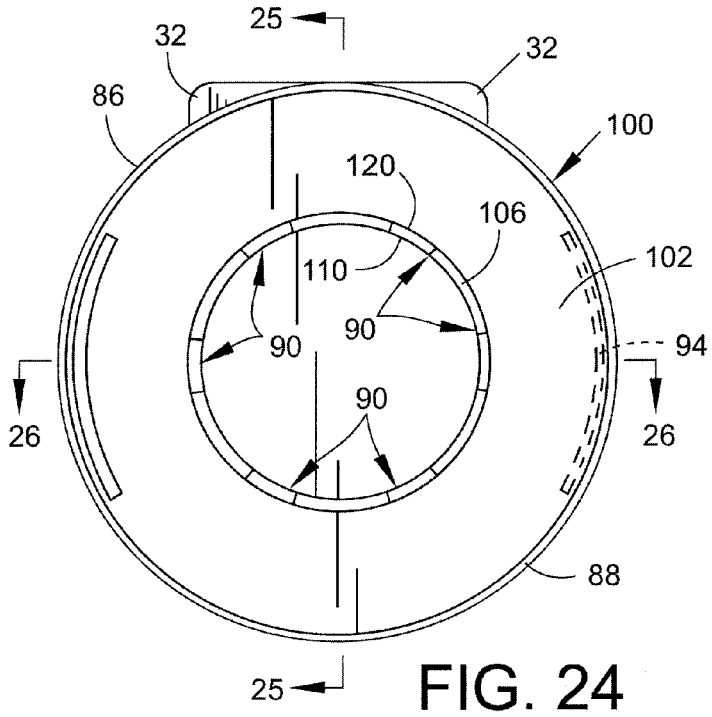
FIG. 24 is a plan view of the container element seen in FIG. 23.
Figure 25:
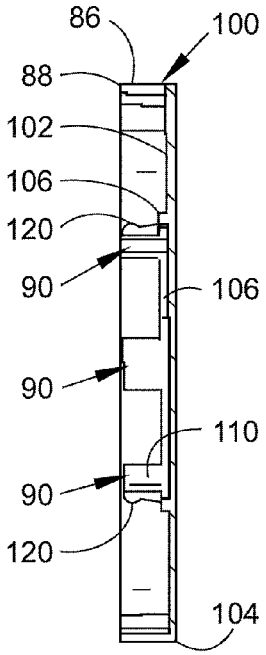
FIG. 25 is a cross-sectional view of the container element seen in FIG. 24 taken along line 25-25.
Figure 26:
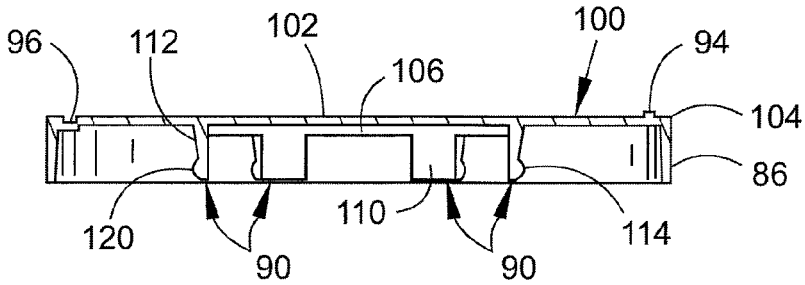
FIG. 26 is a cross-sectional view of the container elements seen in FIG. 24 taken along line 26-26.

FIG. 24 shows a plan view of the sixth container member 100 seen in FIG. 23. FIG. 24 illustrates the relationship of the feet 32 to the periphery 104 of the side wall 102. The feet 32 are roughly triangular with a rounded corner. The long sides of the triangles are collinear forming a flat bottom of the feet 32 upon which a container assembled on two container members 100 may stand. FIG. 24 also illustrates the spacing of the inner wall segments 90 about a circle which is coaxial with the outer wall 86. FIGS. 25 and 26 illustrate further details of the inner walls segments 90 and surrounding structures. A short cylindrical inner wall base 106 extends from the side wall 102 in the same direction as the outer wall 86. The inner wall base 106 is very short, on the order of a tenth of an inch. The inner wall segments 90 extend from the inner wall base 106.

Figure 27:
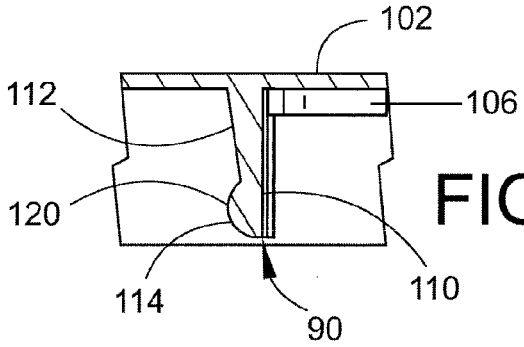
FIG. 27 is an enlarged detailed view of a portion of the container elements seen in FIGS. 23-26.

FIG. 27 shows details of the inner wall segments 90. The inner wall segment 90 has an inside surface 110 which is generally perpendicular to the inner surface of the side wall 102. The inside surface, that is the surface facing the center of the side wall 102, is approximately perpendicular to the side wall. It is not precisely perpendicular as "draft", that is a slight tapering, is provided for the injection molding process. The outside surface of the inner wall segment 90 has a first zone 112 and second zone 114. The first zone is adjacent the side wall 102. The outside surface first zone 112 slants inwardly as it extends away from the side wall 102. The outside surface first zone terminates at the beginning of the outside surface second zone 114 which is an arcuate surface bulging outwardly and then curving inwardly to form the top and join the inside surface of the inner wall segment 90. This creates an inner wall segment having a tapered portion adjacent the side wall 102 tapering to a narrow portion which is joined to an outwardly extending rib 120 formed by the outside surface second zone 114. The inner wall segment 90 is about a tenth to an eighth of an inch thick near its base where it joins the side wall 102.

As can be see best in FIG. 24, the inner wall segments 90 are curved. They are curved so that their inner and outer surfaces lay in circles centered upon the center of the side wall 102. The outermost portions of each of the inner wall segments 90 (the rib 120) lie on a circle having a diameter of 3.07 inches on a container member designed for a three inch tape core. Therefore, when a container member 100 is mounted on a roll of tape, the ribs 120 will be engaged against the inside surface of the core of the roll of tape and will hold the container member 100 in place.

Figure 28:
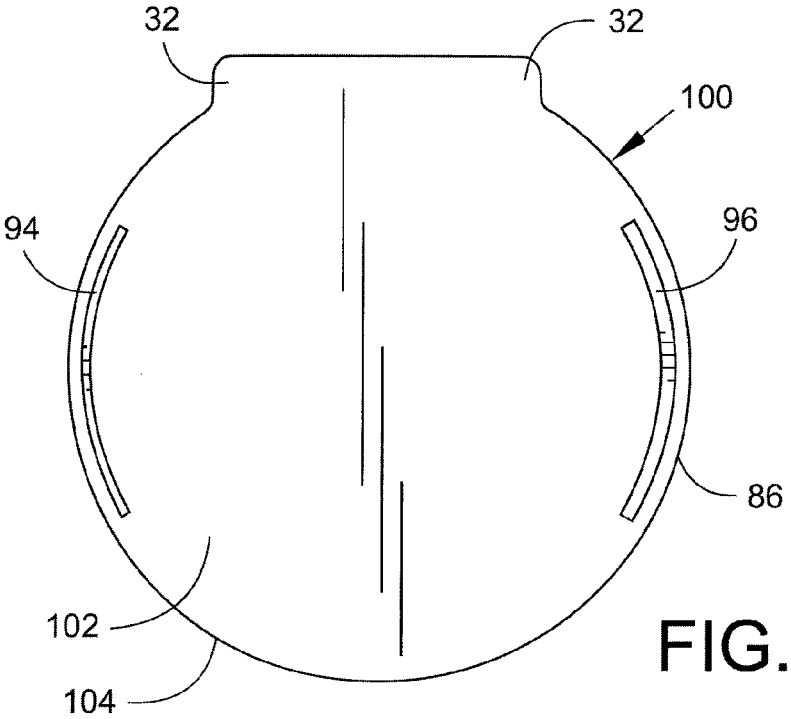
FIG. 28 is a back view of the container element seen in FIGS. 23-27.

FIG. 28 shows the side of the container member 100 which will not engage a roll of tape. The positions of the arcuate rib 94 and groove 96 are shown on the sides of the side wall 102.

FIGS. 29, 30, 31 and 32 illustrate further details of an embodiment having similarities with respect to the embodiment of FIGS. 19 and 20.

Figure 29:
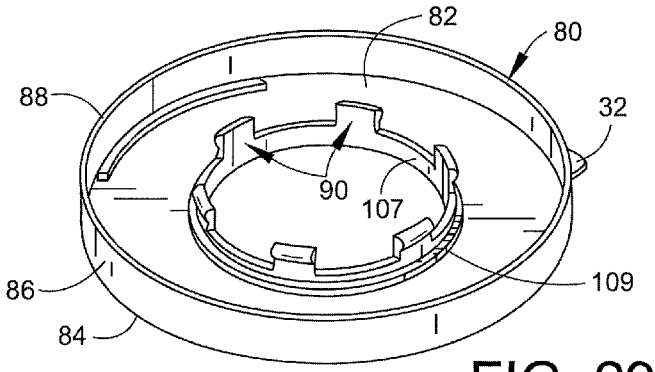
FIG. 29 shows another embodiment of a container for adhesive tape in accordance with the present disclosure.
Figure 30:
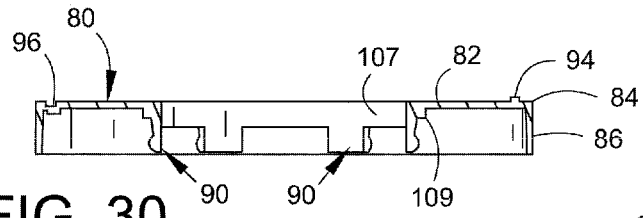
FIG. 30 is a cross-sectional view of the container member seen in FIG. 29.
Figure 31:
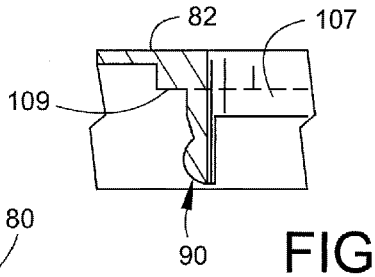
FIG. 31 is an enlarged detail of a portion of the container member seen in FIGS. 29 and 30.
Figure 32:
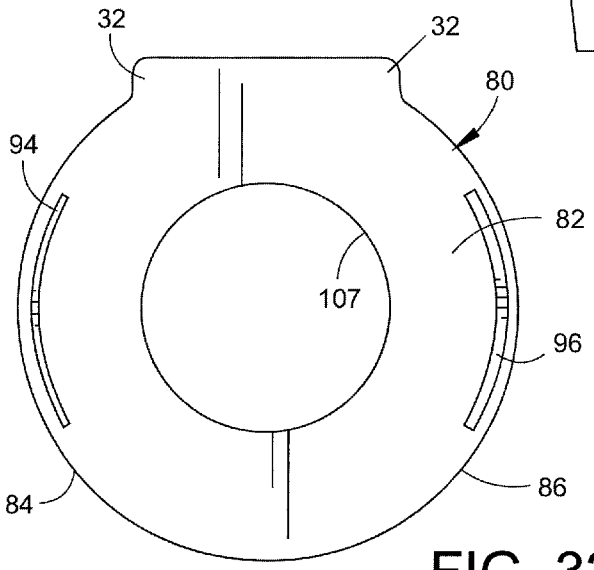
FIG. 32 is a plan view of the embodiment of FIG. 29 seen from the back.

FIG. 32 shows the side of the container member which will normally be away from the roll of tape contained. The side wall is annular with a hole through its center. As can be seen in FIG. 29, an outer wall extends from the periphery of the side wall and inner wall segments 90 also extend from the side wall arranged in a circle inwardly spaced from the outer wall. This arrangement is similar as shown with respect to the embodiment seen in FIGS. 23-28. The difference is that the side wall has a hole within the circle defined by the inner wall segments 90. Additionally, the inner wall base 107 in this embodiment is taller, about 0.2 of an inch high. Also, inner wall base 107 includes a circular flange or ridge core stop 109. This strengthens the positioning of the inner wall segments 90 and the side wall 82. To be described in more detail below, the core stop 109 provides a 'stop' for the tape core and is particularly adapted for tape rolls having a core of different width than the surrounding tape (FIG. 33A) and for patterned tape rolls (FIGS. 33 and 34). In all other respects, the embodiment seen in FIGS. 29-32 is similar to the embodiment seen in FIGS. 20-28.

It will be appreciated that design elements from one embodiment of the disclosure may be implemented in other embodiments of the disclosure. Moreover, the embodiments may be altered in size and proportion to accommodate different widths of tape, tapes on different size core, tape rolls wherein the width of the tape is different than the width of the core, different lengths of tape resulting in larger diameter tape rolls, and the like. Structures providing for the flexible containment of rolls of tape either singly or multiply are described. These structures are useful in the shipping of tape, the retailing of tape, and the storage of tape during usage and between the usage intervals. The invention is applicable to protecting adhesive tapes used in painting and in other applications where protection of the tape or its components from environmental conditions or other potential damage is appropriate.

Referring now to FIG. 33, a roll of non-uniform tape roll 210 comprises a core 212 having an inner cylindrical surface 214. A length of adhesive tape 216 is wound on the core 212. The roll of tape 210 is not conventional. As shown in FIG. 33, the adhesive tape 216 is formed by a strip of flexible material 252 having a top surface 254, as shown in FIG. 33, and a bottom surface (not shown). A pressure-sensitive adhesive coating is applied to the bottom surface of the material. The strip of material 252 may be wound upon itself to form a roll 258. The strip of material 252 has non-uniform or patterned side edges 260, 261 which extend along opposing sides of the strip of material 252. In the present disclosure, at least one side edge 260 and/or 261 of the strip of material 252 is shaped to form a repeating pattern 262 along the length of the strip of material 252. The repeating pattern 262 can take the form of a wave (ocean wave) pattern.

Figure 33A:
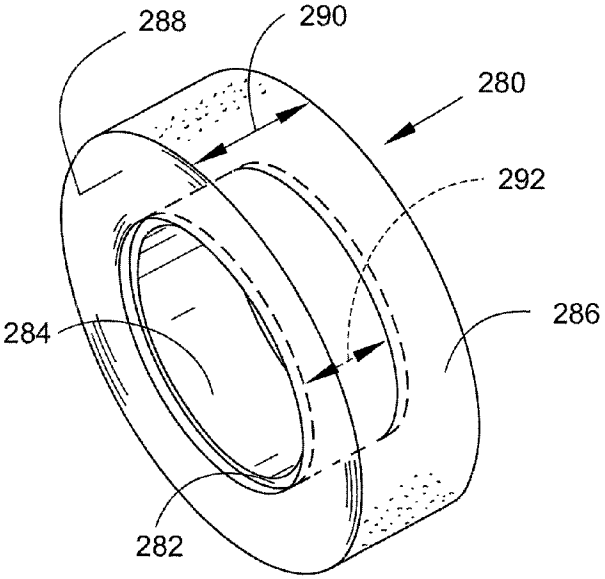
FIG. 33A depicts a top perspective view of a third variety of a roll of masking tape having treated edges in accordance with the present invention.
Figure 33:
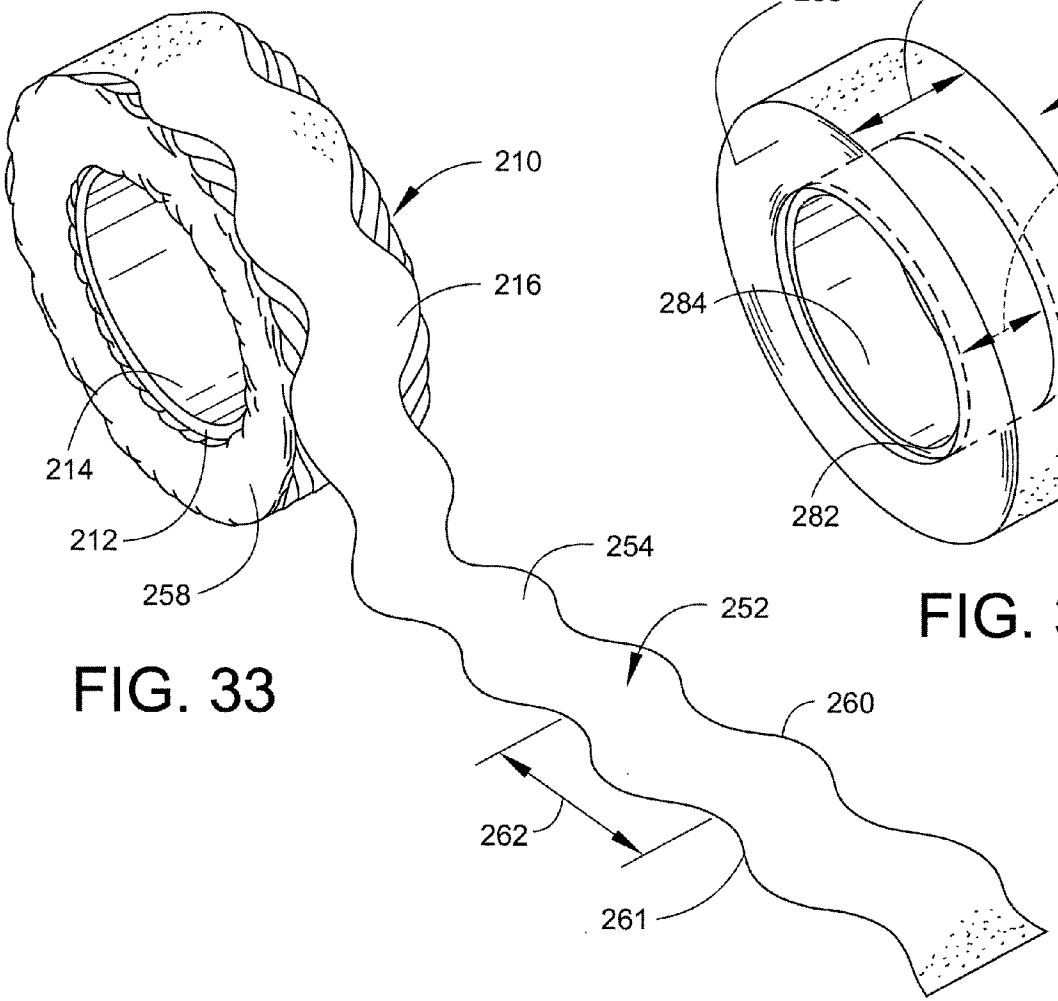
FIG. 33 depicts a top perspective view of a second variety of a roll of masking tape having a curvilinear pattern in accordance with the present invention.
Figure 34:
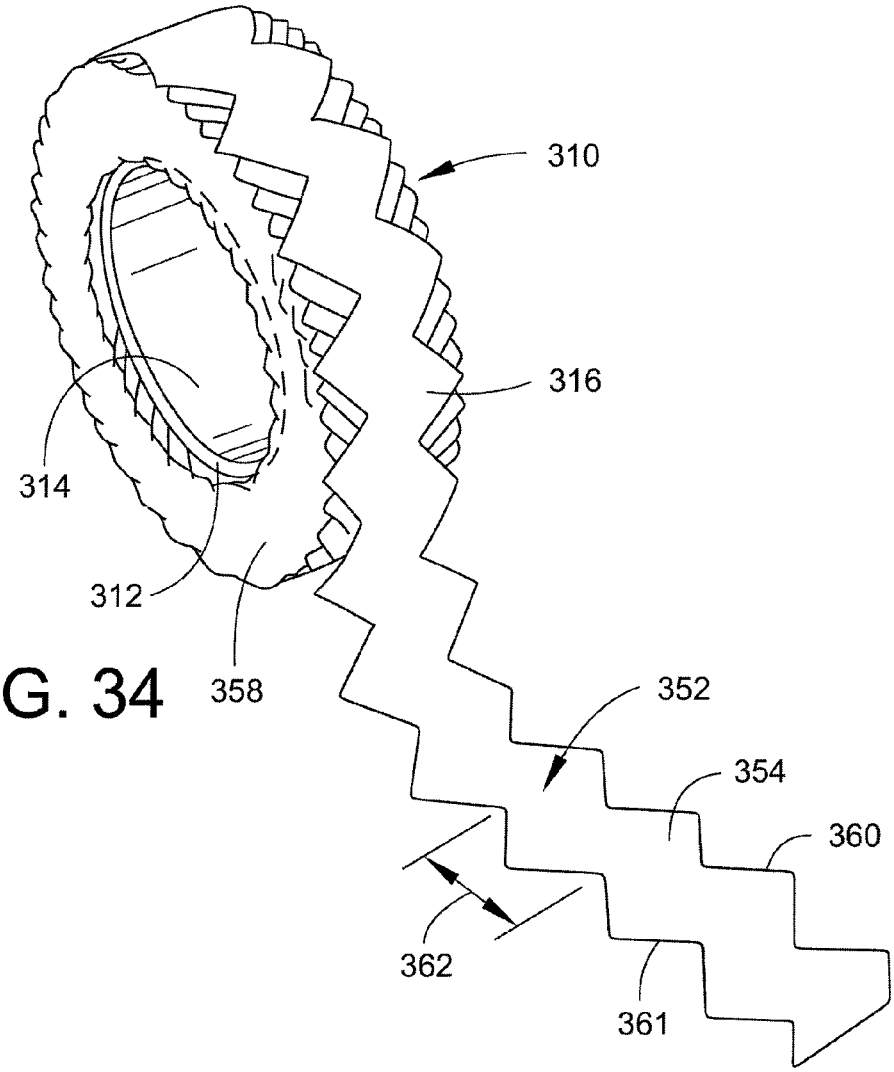
FIG. 34 depicts a top perspective view of a fourth variety of a roll of masking tape having an angular pattern in accordance with the present invention.

Referring now to FIG. 33A, a roll of uniform tape 280 comprises a core 282 having an inner cylindrical surface 284. A length of adhesive tape 286 is wound on the core 282. The roll of tape 280 can include treated edges 288 which have been treated after manufacturing or after cutting the tape roll to size. The treatment can result in the width of the tape 290 being greater than the width of the tape core 292. This arrangement can also be the result of intentional winding of a tape width onto a tape core having a slightly lesser width to prevent 'telescoping' of the tape. A pressure-sensitive adhesive coating is typically applied to the bottom surface of the tape material. The edges 288 can be treated with a substance which gels upon exposure to latex paints. This treatment can result in the width of the tape being greater than the width of the core. It is to be appreciated that the width of flange 109 is substantially equal to the thickness of core 282. Thus, in a mounted arrangement (not shown), flange 109 will provide a core stop with a terminal end of core 282 when tape 280 is placed in container member 80.

Referring now to FIG. 34, another roll of non-uniform tape 310 is therein shown comprising a core 312 having an inner cylindrical surface 314. A length of adhesive tape 316 is wound on the core. The roll of tape 310 is not conventional. As shown in FIG. 34, the adhesive tape 316 is formed by a strip of flexible material 352 having a top surface 354, as shown in FIG. 34, and a bottom surface (not shown). A pressure-sensitive adhesive coating is applied to the bottom surface of the material. The strip of material 352 may be wound upon itself to form a roll 358. The strip of material 352 has non-uniform or patterned side edges 360, 361 which extend along opposing sides of the strip of material 352. In the present disclosure, at least one side edge 360 and/or 361 of the strip of material 352 is shaped to form a repeating pattern 362 along the length of the strip of material 352. The repeating pattern 362 can take the form of a zigzag (i.e. lightning bolt) pattern.

The adhesive tape lengths 216 and 316 have varying widths as measured from one edge to another (i.e. between respective edges 260 and 261 and edges 360 and 361) along the respective repeating patterns 262, 362. It is to be appreciated that the rolls can have any variety of repeating or non-repeating patterns along the edges. The size of the tape and pattern can vary in practicing the present invention. One aspect of the present invention is the provisioning of containers for protection of the tape edges for various patterns at reduced cost and reduced inventory part count.

The side edges 260, 261 for a length of adhesive tape 216 do not coincide with the sides or terminal ends of the tape core 212. The two side edges 260, 261 may not be identical to one another. The side edges 260, 261 of the roll of tape require extra protection because the edges 260, 261 are not completely supported by the underlying core nor by the underlying wraps of the tape 216. It is to be appreciated that if the side edges 260, 261 have a consistent wave period, then each successive wrap of the tape around the roll will be offset, i.e. non-coincidental, from the previous and subsequent wraps due to the changing (i.e. increasing) circumference of each successive wrap. Therefore, each individual circumferential wrap is offset from or non-coincidental to previous wraps and thus not completely supported by the underlying wraps (FIGS. 33 and 34). It is to be appreciated that the patterned edges may extend beyond the terminal ends of the tape core 212, 312 resulting in a roll of tape wherein the tape is not completely supported by or coincidental with the underlying tape core.

The present disclosure provides for protection of the resulting more fragile or treated edges and outer circumferential wrap of a tape roll forming a pattern from being nicked, gouged or dented by objects, as well as, by the container itself enclosed therearound. If the tape contains a particularly intricate pattern and/or treated edges, the edges will be particularly venerable and it will be desirable to protect the edges and outer circumference of the roll of tape from contact with the container side walls and outer walls. As discussed above, if the tape contains materials which may react to substances that may be encountered in retailing, use of the tape, or in the atmosphere, it may be appropriate to protect the edges, and indeed the entire roll of tape, from the environment.

Referring again to FIG. 33, in the embodiments shown, the side edges 260, 261 of the tape 216 are shaped to form a wave pattern 262. It is contemplated that any two-dimensional geometric pattern may be used. For example, as shown in FIG. 34, a zigzag (lightning bolt) pattern 362 may be used. It is also contemplated that the pattern may be of any size and any wave period (i.e. repeating frequency). Other patterns are contemplated as part of this disclosure and include, by way of example, a jigsaw (interlocking curves) pattern; a square pattern, which may be used to simulate bricks; a large square pattern, which may be used to simulate blocks; a sawtooth pattern; a scalloped pattern; and other single or dual edge patterns.

Where both side edges of the strip of material are shaped to form a pattern, the patterns on the side edges may be identical. For example, as shown in FIG. 34, both side edges are formed as the angular pattern 362. Alternatively, the side edges may form different patterns (not shown) where, for example, one side edge can form an angular pattern and the other side edge can form a scalloped pattern. Where the patterns are identical on both side edges, the patterns may be aligned with each other such that the pattern on one side edge is a mirror image of the pattern on the other side edge. Alternatively, the patterns on the side edges may be offset from each other along the length of the strip of material 252, as shown in FIG. 33.

Figure 35:
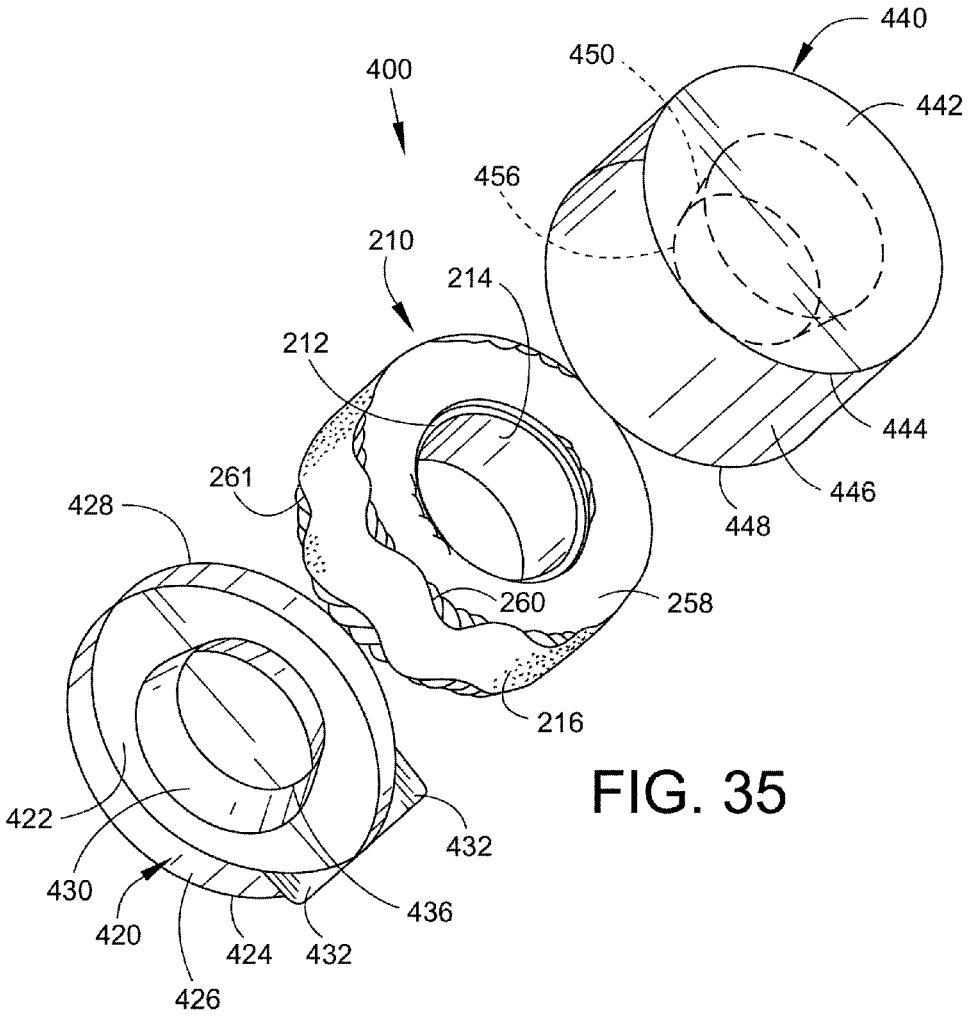
FIG. 35 is a disassembled view of another embodiment of two container elements on either side of a roll of tape in the orientation the container halves are in for application.

Referring now to FIG. 35, roll of tape 210 is shown with another embodiment for a container 400. The non-uniform sides 260, 261 of the roll of tape will necessitate particular protection to the entire tape 216. If a particular tape is provided with irregular edges, one may wish to protect all areas of the tape 216 from being nicked, gouged or dented by objects and by the container itself. If the tape 216 contains adhesive which is particularly tenacious or otherwise active, it may be appropriate to protect all areas of the roll of tape from contact with unintended substrates and from contact with the inside surfaces of the container. If the tape 216 contains materials which may react to substances that may be encountered in retailing, use of the tape, or in the atmosphere, it may be appropriate to protect the entire roll of tape from the environment and from all contact.

A first container member 420 comprises a circular side wall 422 having a periphery 424, an outer wall 426, an inner wall segment 430 and feet 432. The outer wall 426 is cylindrical and extends from the periphery 424 of the side wall 422 to a circular outer wall remote edge 428. The distance from the periphery 424 of the side wall 422 to the outer wall remote edge 428 is generally uniform giving the outer wall a generally uniform height around its entire circumference. The diameter of the outer wall 428 is selected to be slightly greater than the diameter of the roll of tape 210 to be contained.

The inner wall segment 430 illustrated in FIG. 35 is a continuous, conical or tapered, inner wall segment 430. The tapered inner wall segment 430 has a height dimension selected to be less than half the width of the core 214 of the roll of tape 210 to be contained. The diameter of the inner wall segment 430 is selected so that the inner wall segment 430 tapers (i.e. decreases in diameter) from its side wall 422 to the remote or terminal edge 436. It is to be appreciated that the diameter of inner wall segment 430 is less than the diameter of the tape core 212 at remote edge 436 and more than the diameter of tape core 212 at side wall 422.

Two feet 432 extend from the outer wall remote edge 428. The feet 432 can be adjacent one another having a common flat edge ending in rounded corners leading to second edges which join the outer wall remote edge. This forms two feet 432 with a common straight bottom edge.

A second container member 440 is seen to the right of the roll of tape 210 in FIG. 35. The second container member 440 comprises a circular side wall 442 having a periphery 444, an outer wall 446, and an inner wall segment 450. The outer wall 446 is cylindrical and extends from the periphery 444 of the side wall 442 to a circular outer wall remote edge 448. The distance from the periphery 444 of the side wall 442 to the outer wall remote edge 448 is generally uniform giving the outer wall a generally uniform height around its entire circumference. The diameter of the outer wall 448 is selected to be slightly greater than the diameter of the roll of tape 210 to be contained. The second container member 440 is orientated such that the inner wall segment 450 of the second container member 440 will engage the right hand side of the tape core 212 while the inner wall segment 430 of the first container member 420 engages the left hand side of the tape core 212. The inner wall segment 450 illustrated in FIG. 35 is a continuous, conical or tapered, inner wall segment 450. The tapered inner wall segment 450 has a height dimension selected to be less than half the width of the core 214 of the roll of tape 210 to be contained. The diameter of the inner wall segment 450 is selected so that the inner wall segment 450 tapers (i.e. decreases in diameter) from its side wall 442 to the remote or terminal edge 456.

Figure 36:
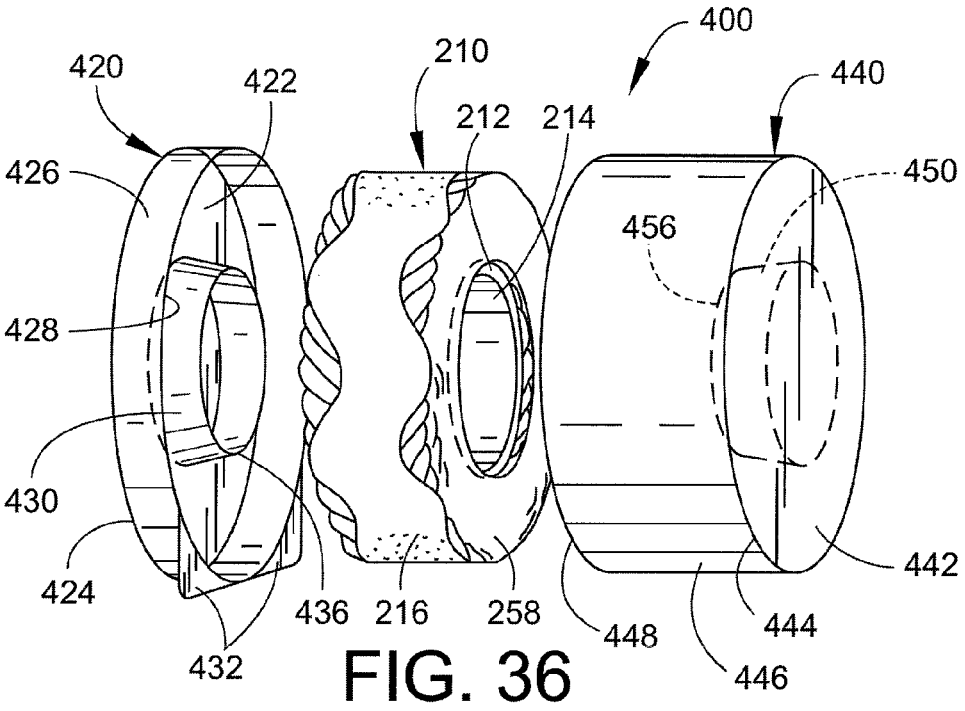
FIG. 36 is a view similar to FIG. 35 with the container halves more closely approaching the roll of tape; and, FIG. 37 is a view of the container of FIG. 35 assembled onto the roll of tape enclosing the roll of tape.
Figure 37:
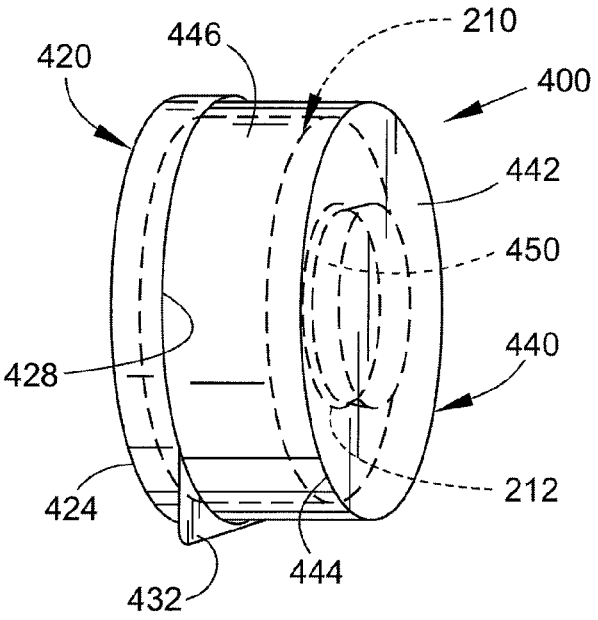

With reference to FIG. 36, the first container member 420, the second container member 440 and the roll of tape 210 are shown properly aligned for engagement. With reference to FIG. 37, the first container member 420 and the second container member 440 have been brought together engaging the roll of tape 210 and completely enclosing and containing the roll of tape 210. It is to be appreciated that roll 210 is suspended between and separated from side walls 422 and 442 and between outer walls 426 and 446, such that edges 260, 261 and wraps 216 are prevented from coming into contact with any of the walls of the container 400. The roll of tape 210 is thus protected from injury by impact with sharp objects and by impact with the inside of the container 400, and by degradation by interaction with environmental constituents.

Although the container connecting structures have been described herein with reference to particular rolls of tape, it should be understood that this disclosure may be useful and useable in other environments and may be modified to include equivalent structures and other implementations of the improvements. It is intended to include all such modifications to the embodiments and others and the equivalents thereof.

It is claimed:

1. A container and a roll of adhesive tape wound upon a cylindrical core, comprising:

the roll of adhesive tape having a first width between a first side and a second side and an outer diameter, and the cylindrical core having an inner surface and an inner surface diameter;

a first member of the container comprising a first side wall having a first circular periphery, a first outer wall extending from the first side wall outer periphery and terminating at a first outer wall edge, the first outer wall having a substantially uniform first selected outer wall height generally perpendicular to the first side wall, the first outer wall adapted to surround at least a portion of the width of the roll of adhesive tape; at least one first inner wall segment extending from the first side wall inside the first outer periphery, the at least one first inner wall segment adapted to engage at least a portion of the core inner surface;

a second member of the container comprising a second side wall having a second circular periphery, a second outer wall extending from the second side wall outer periphery and terminating at a second outer wall edge, the second outer wall having a substantially uniform second selected wall height generally perpendicular to the second side wall, the second outer wall adapted to surround at least a portion of the width of the roll of adhesive tape; at least one second inner wall segment extending from the second side wall inside the second outer periphery, the at least one second inner wall segment adapted to engage at least a portion of the core inner surface;

the first member and the second member adapted to engage the first side and the second side of the roll of tape by engagement of the at least one first inner wall segment and the at least one second inner wall segment with the core inner surface;

the roll of adhesive tape having a second width comprising additives added to respective edges of at least one side of the roll of adhesive tape, wherein the additives gel upon exposure to a liquid; and, wherein said first outer wall edge and said second outer wall edge are in contiguous contact wherein the roll of adhesive tape and its respective edges are isolated from ambient air and moisture.

2. The container and the roll of adhesive tape of claim 1 wherein the first member has at least two first inner wall segments spaced from one another and the second member has at least two second inner wall segments spaced from one another.

3. The container and the roll of adhesive tape of claim 2 wherein the first member has at least three first inner wall segments spaced from one another and the second member has at least three second inner wall segments spaced from one another.

4. The container and the roll of adhesive tape of claim 1 wherein the inner wall segments extend generally perpendicular to the side walls having proximal ends adjacent the side walls and distal ends away from the side wall and ribs extending outwardly toward the outer walls at the distal ends of the inner walls.

5. The container and the roll of adhesive tape of claim 4 wherein the ribs extend in a circumferential direction at the distal end of the inner wall segments.

6. The container and the roll of adhesive tape of claim 1 wherein the first selected outer wall height is approximately the same as the second selected outer wall height.

7. The container and the roll of adhesive tape of claim 1 wherein the first selected outer wall height is substantially different from the second selected outer wall height.

8. The container and the roll of adhesive tape of claim 1 wherein the first member is identical in shape to the second member.

9. The container and the roll of adhesive tape of claim 1 wherein the first member is identical in shape to the second member except for the first and second selected outer wall heights.

10. The container and the roll of adhesive tape of claim 9 wherein the first side wall and the second side wall each have an outwardly facing surface, the outer wall surface of each of the first side wall and the second side wall having at least one indentation at a selected location and at least one projection adapted to engage the indentation of an identical member when the members are placed into contact with the outwardly facing surface of one facing the outwardly facing surface of the other, whereby adjacent containers of tape may be fixed together.

11. The container and the roll of adhesive tape of claim 10 wherein the indentation is an arcuate groove having a rectangular cross section and the projection is an arcuate rib having a rectangular cross section.

12. The container and the roll of adhesive tape of claim 1 wherein the cylindrical core includes a width; and, the second width is greater than the core width.

* * * * *